US006315498B1

(12) United States Patent
Baugh et al.

(10) Patent No.: US 6,315,498 B1
(45) **Date of Patent: *Nov. 13, 2001**

(54) THRUSTER PIG APPARATUS FOR INJECTING TUBING DOWN PIPELINES

(75) Inventors: Benton F. Baugh, Houston, TX (US); James R. Crawford, Lafayette, LA (US)

(73) Assignee: Superior Energy Services, LLC, Harvey, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/185,563

(22) Filed: Nov. 4, 1998

Related U.S. Application Data

(60) Provisional application No. 60/066,380, filed on Nov. 21, 1997, and provisional application No. 60/067,503, filed on Dec. 4, 1997.

(51) Int. Cl.[7] ..... F16L 1/00
(52) U.S. Cl. ..... 405/184; 405/154.1; 166/383
(58) Field of Search ..... 166/312, 383, 166/77.2, 71.3, 384; 254/134.4; 405/154.1, 184, 156, 184.1, 184.5; 15/104.061, 104.062

(56) References Cited

U.S. PATENT DOCUMENTS

| | | | | |
|---|---|---|---|---|
| 712,488 | | 11/1902 | Black | 166/241.3 |
| 3,467,196 | | 9/1969 | Kinsman et al. | 166/315 |
| 3,495,546 | * | 2/1970 | Brown et al. . | |
| 3,525,401 | * | 8/1970 | Hanson et al. | 166/384 X |
| 3,763,896 | * | 10/1973 | Horne et al. | 15/104.061 X |
| 3,827,487 | | 8/1974 | Jackson et al. | 166/77 |
| 4,073,302 | * | 2/1978 | Jones | 134/167 C |
| 4,360,290 | * | 11/1982 | Ward | 405/170 |
| 4,585,061 | | 4/1986 | Lyons et al. | 166/77 |
| 4,729,429 | | 3/1988 | Wittrisch | 166/65.1 |
| 4,756,510 | * | 7/1988 | Klamm et al. | 405/154 X |
| 4,919,204 | * | 4/1990 | Baker et al. | 166/312 X |
| 5,069,285 | * | 12/1991 | Nuckols | 166/311 |
| 5,180,009 | * | 1/1993 | Sneed | 166/383 X |
| 5,188,174 | | 2/1993 | Anderson et al. | 166/77 |
| 5,208,936 | * | 5/1993 | Campbell | 15/104.061 |
| 5,209,304 | * | 5/1993 | Nice | 166/383 |
| 5,309,990 | | 5/1994 | Lance | 166/177 |
| 5,309,993 | | 5/1994 | Coon et al. | 166/115 |
| 5,316,094 | | 5/1994 | Pringle | 175/74 |
| 5,429,194 | * | 7/1995 | Nice | 166/383 |
| 5,445,224 | * | 8/1995 | Comeaux | 166/312 |
| 5,447,200 | | 9/1995 | Dedora et al. | 166/311 |
| 5,494,103 | | 2/1996 | Surjaatmadja et al. | 166/222 |
| 5,497,807 | * | 3/1996 | Rogers | 405/154 X |
| 5,566,764 | | 10/1996 | Elliston | 166/385 |
| 5,692,563 | | 12/1997 | Krueger et al. | 166/85.5 |

(List continued on next page.)

FOREIGN PATENT DOCUMENTS

| | | | | |
|---|---|---|---|---|
| 0 187 599 | | 7/1986 | (EP) . | |
| 894117 | | 4/1962 | (GB) . | |
| 1132503 | | 11/1968 | (GB) . | |
| 05161884 | * | 6/1993 | (JP) | 15/104.061 |
| 94/23174 | | 10/1994 | (WO) . | |
| 97/12116 | | 4/1997 | (WO) . | |

*Primary Examiner*—Robert E. Pezzuto
*Assistant Examiner*—Jong-Suk Lee
(74) *Attorney, Agent, or Firm*—Garvey, Smith, Nehrbass & Doody, LLC

(57) ABSTRACT

A method and apparatus have been developed which inserts and withdraws tubing from pipes without bending or kinking the tubing. Beneficially, the method and apparatus may be employed to insert and withdraw tubing to depths greater than ever possible before. The method involves using a thruster pig to provide force to inject the tubing. The thruster pig uses a pressure differential to urge the tubing into and out of the pipe. Advantageously, check valves or relief valves allow fluid to be pumped down the tubing and out the front of the thruster pig, and then to flow back through the valves and up the annulus between the pipe and the tubing.

17 Claims, 2 Drawing Sheets

U.S. PATENT DOCUMENTS 5,695,009 12/1997 Hipp ..... 166/196
5,704,393 1/1998 Connell et al. ..... 137/614.21
5,795,402 * 8/1998 Hargett, Sr. et al. ..... 15/104.061 X
6,003,606 * 12/1999 Moore et al. ..... 166/381
6,024,515 * 2/2000 Konwinski et al. ..... 405/184

* cited by examiner

THRUSTER PIG APPARATUS FOR INJECTING TUBING DOWN PIPELINES

CROSS REFERENCE TO PATENTS

This application claims priority from provisional patent application Ser. No. 60/066,380 filed on Nov. 21, 1997, entitled "Method and Apparatus of Injecting Coil Tubing Down Pipelines", and provisional patent application Ser. No. 60/067,503 filed on Dec. 4, 1997, entitled "Method and Apparatus of Injecting Coil Tubing Down Pipelines".

FIELD OF THE INVENTION

The instant invention relates to an apparatus for injecting tubing down a pipe or open hole. In particular, the instant invention relates to an apparatus for injecting coiled tubing down a pipe in deep water to provide servicing of the pipe to remove paraffinic blockages, hydrates, scale, or solid debris from the pipe. More particularly, the instant invention relates to an apparatus for injecting tubing into a pipe, wherein a substantial portion of the pipe is horizontal.

BACKGROUND OF THE INVENTION

In the development and production of subterranean hydrocarbon deposits and other energy sources there are many occasions when it is necessary to insert an elongated tube from the surface deep into a pipe or open hole. Such pipes or holes may be vertical, horizontal, curved or combinations thereof and may be part of, for example, a well, pipe line, production line, or drill pipe. The inserted tube has an outer diameter that is smaller than the inner diameter of the pipe or open hole. The insertion of the tube may be for such purposes as, for example, removing blockages or general servicing.

Often during repair or servicing of a pipe a rig capable of handling long lengths of straight screw-type pipes is not available. In many cases the strength of larger diameter straight screwed tubing is not needed, so the cost of running this type of tube is not justifiable. In these cases it is often advantageous to use a long, continuous, injected tubing called coiled tubing. Many apparatuses have been developed to insert or inject a continuous length of relatively thin walled steel tubing into a pipe or open hole from a large reel or spool on the surface.

Large forces are often necessary to insert and withdraw thousands of feet or more of steel tubing into a pipe or open hole which may be filled with hydrocarbons or other materials. Most apparatuses focus on the injector head located where the smaller tubing is injected into the larger tubing. The injector head grips the tubing along its length and, in conjunction with a motor, guides and forces the tubing into the pipe via, for example, a dual, opposed conveyor belt on the surface of the well. Typical injector heads are described in, for example, U.S. Pat. Nos. 3,827,487; 5,309,990; 4,585,061; 5,566,764; and 5,188,174 which are incorporated herein by reference.

Unfortunately, the apparatuses of these patents are problematic in many respects. One such problem is that the tubing may be bent or kinked, i.e., the tubing becomes helical, down the well due to the large forces pushing against it and the weight of the tubing itself. This is especially problematic when the pipe is deviated from vertical. As the pipe becomes more horizontal, the weight of the coiled tubing itself no longer acts as a force pulling the tubing along, and instead acts against the wall of the pipe, creating friction. In addition, the weight of the tube no longer acts to straighten the coiled tubing, and the coil encourages coiling in the pipe. Such a coil, coupled with friction, results in increased force between the coiled tube and the inner diameter of the pipe, and this effectively binds the tubing. As a result of this and other problems, such prior art devices cannot effectively insert more than about 3,000 to about 5,000 feet (900 to 1500 meters) of tubing in substantially horizontal pipe.

Another typical problem with prior art devices is that the injector equipment associated with such devices is often relatively heavy, difficult to move, and complex due to a large chain assembly machinery which serves as a conveyor belt to force the tubing into the pipe.

Other methods have been employed to increase the length to which tubing can be injected. U.S. Pat. No. 5,704,393 describes an apparatus that can be set in the well at the end of the coiled tubing string at a determinable location. The apparatus is a valve apparatus, a packer apparatus, and a connector. Seals are provided that allow the coiled tubing, but not fluid, to move in a centrally located bore through the packer apparatus. The apparatus is immobile against the outer pipeline, and has the ability restrict or prevent fluid flow. Once the packer is set, the annular pressure, i.e., the pressure differential between the pipeline and the interior of the coiled tubing, is increased by injecting fluid into the annular volume. This increased pressure stiffens and straightens the coiled tubing, allowing for increased distance of injection of coiled tubing into the pipeline.

It is apparent that what is needed in the art is an apparatus that allows one to readily insert and withdraw tubing from a pipe for long distances, i.e., greater than about 6,000 feet (1830 meters), without bending or kinking the tubing. It would be beneficial if such an apparatus could be employed to insert and withdraw tubing from a substantially horizontal pipe of extended length of greater than 6,000 feet (1830 meters), and that the tubing can extend past turns. Moreover, it would be of great benefit if such an apparatus was portable, easily handled, and could be adapted to handle tubing of differing diameters.

SUMMARY OF THE INVENTION

A new apparatus has been developed that inserts and withdraws tubing from pipes or open holes. Beneficially, the new apparatus may be employed to insert and withdraw tubing to lengths of over 6000 feet (1830 meters), preferably greater than 26,000 feet (9900 meters), and more preferably greater than 60,000 feet (18,300 meters). Advantageously, the apparatus is portable, easily handled, and adaptable to handle tubing of differing diameters.

The instant invention comprises a thruster pig that utilizes a pressure differential across the thruster pig to generate force needed to inject tubing down a pipe or well. The thruster pig is a device that firmly attaches to or is integral with the tubing to be inserted in the pipe. The body of the thruster pig has an outer diameter greater than the outer diameter of the injected tubing and equal to or smaller than the inner diameter of the pipe.

The attachment of the thruster pig to the tubing may be by any conventional method. One preferred method is to use standard releasing subs, known in the art, that allow the thruster pig to be released by pumping a ball down the injected tubing. The attachment point may also contain a hinge, ball joint, or swivel joint that allows the thruster pig to more easily orient itself in the pipe. The seal between the injected tubing and the thruster pig can be a metal weld, a screw type seal, a compression type seal, or any other seal known to the art.

The thruster pig has a sealing apparatus, for example one or more chevrons, to impede fluid migration between the body of the thruster pig and the inner surface of the pipe. This effectively creates an annulus between the injected tubing and the pipe so that pressure can be applied to the rear of the thruster pig. The shape of the thruster pig is not important, so long as the thruster pig makes essentially a fluid-tight seal between the injected tubing and pipe.

The thruster pig has an opening that allows fluids pumped down the center of the injected tubing to pass to the front of the thruster pig. The opening may contain the injected tube, or it may be a continuation of that flow path. When the thruster pig is moving forward, fluid may also be withdrawn from the volume ahead of the pig through the opening.

The thruster pig has a means for allowing fluids to flow from the annulus through the device as the thruster pig is being withdrawn. This means consists of one or more valves, in series or in parallel, that allow the user to pumped fluids to pass through the thruster pig to the annulus behind the thruster pig. These valves are often check valves. The check valves are designed to let the fluids injected down the tubing to circulate through the annulus and out of the pipe.

Finally, the thruster pig has a second set of valves or check valves allows fluids under some conditions to flow from the annulus between the tubing and the interior surface of the pipe to the front of the pig. These check valves may be actuated by higher pressure differentials across the thruster pig. These check valves are limits on the pressure that can be exerted against the back of the thruster pig during injection, as they will open and allow fluid to pass. These valves are advantageously open when the thruster pig is being withdrawn, so that any fluids that are behind the thruster pig can move to the front of the thruster pig, and therefore need not be swabbed from the well.

The instant invention also is a method for injecting tubing for long distances into a pipe. This method comprises feeding a coil tubing into a pipe which has a larger diameter than said coil tubing. The injected tubing has a thruster pig located at or near the distal end of the injected tubing. The injected tubing also has one or more skate apparatuses which are attached to said tubing at predetermined intervals. After the thruster pig is inside the pipe, at least a portion of the force needed to inject the tubing into the pipe is provided by pressure exerted on the annulus between the pipe and the injected tube, and therefore also exerted on the back of the thruster pig. The pressure differential between the front of the thruster pig and the rear of the thruster pig provides force to pull the injected tubing into the pipe.

The instant invention also is a method for withdrawing said injected tubing from the pipe, said method comprising opening a normally closed aperture through the body of the thruster pig, said aperture allowing fluid migration from the annulus to the pipe that is ahead of the thruster pig. Optionally, an equalizing valve can be ran in the thruster pig, or the coiled tubing can be opened at the reel to eliminate the annular force on the thruster pig as it is removed from the pipe line or well. In some cases, such as thrusting the coiled tubing into the pipe or well with an electric line inside of the pipe, these valves can be opened or closed using the electric power available.

Optionally, pressure may be exerted through the injected tubing to the pipe ahead of the thruster pig, said pressure being greater than the pressure in the annulus behind the thruster pig, thereby providing a portion of the force needed to withdraw the injected tubing from the pipe.

DETAILED DESCRIPTION OF THE INVENTION

As used herein, the term "injected tubing" includes tubing or screwed pipe injected into other pipe. The coiled tubing or pipe may be of any diameter such as 1 inch, 1.25 inch, 1.5 inch, 1.75 inch, 2 inch, 2.375 inch or greater. The size of the coiled tubing or pipe is determined by the size of the pipe line or wellbore and the purpose for inserting the tubing. Several reels of coiled tubing may be joined together to inject to greater lengths than a single reel can reach. Joining several reels also helps overcome some weight restrictions encountered on some locations where it would be impossible to lift a reel of pipe with more than 50,000 feet of pipe on it. These reels are connected by methods known to the art. The injected tubing may be coiled or jointed pipe, i.e., straight pipe joined by, for example, standard oil field threaded unions such as CS Hydril. The injected tubing may be joints of traditional tubing used in oilfield drilling and production operations, such as 2.375 inch nominal outer diameter tubing.

As used herein, the term "pipe" includes any steel or other pipe or tubing into which the injected tubing passes. While pipes and open holes may be any shape, typically, they are substantially cylindrical. As a practical matter, the pipe can be 2 inch to about 24 inch or greater nominal outer diameter pipe. The pipe may be threaded or welded. A portion of the pipe is partially horizontal. The pipe may be a wellbore.

As used herein, the term "partially horizontal" includes pipe, continuous tubing or pipe, and open holes in which a fraction of the pipe or tubing has a vertical rise over run of about 0.6 or less measured in the direction so that both rise and run are positive units of length. The pipe may include sections in which the rise over run is greater than 0.6 and may include turns.

As used herein, the term "essentially fluid-tight seal" means the thruster pig is "sealingly engaged" to the pipe, i.e., that the thruster pig is a substantial restriction to flow of fluids.

Figure 1:
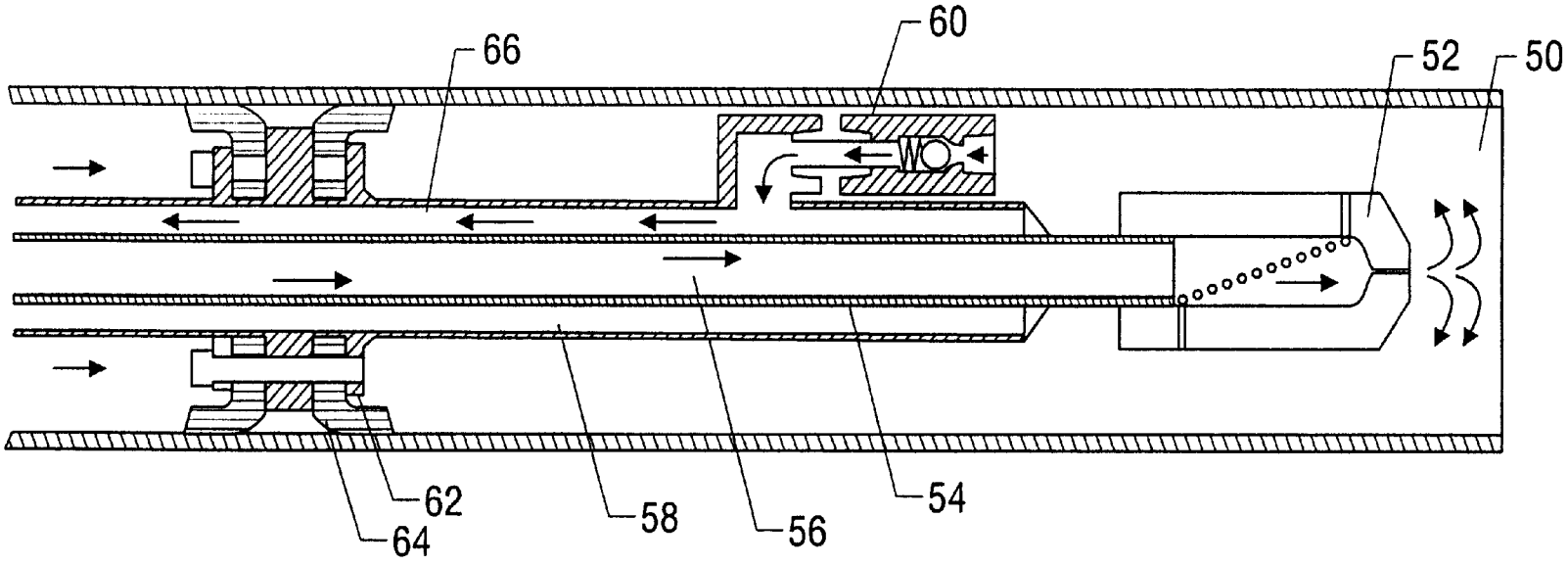
FIG. 1 is an embodiment of the thruster pig.

As shown in FIG. 1, the thruster pig has a body 58 having a outer diameter greater than the outer diameter of the injected tubing 54. The outer diameter of the thruster pig is about the same diameter as the interior of the pipeline.

There is an attaching device (not shown) that secures the thruster pig body to the injected tubing. One preferred method of attachment is to use standard releasing subs, known in the art, that allow the thruster pig to be released by pumping a ball down the injected tubing. The attachment point may also contain a hinge, ball joint, or swivel joint that allows the thruster pig to more easily orient itself in the pipe. The seal between the injected tubing and the thruster pig can be a metal weld, a screw type seal, a compression type seal, or any other seal known to the art.

As a practical matter, at least one thruster pig is usually attached near, i.e., within about 2000 feet of, preferably within 100 feet of, the end of the tubing. The thruster pig may, under certain circumstances, be advantageously placed further back on the injected tubing. There may also be occasions where more than one thruster pig is attached to a line.

There is one or more sealing apparatuses 64 to impede fluid migration between the body of the device and the inner surface of the pipe, thereby creating an annulus behind the thruster pig between the injected tubing and the pipe. The sealing means necessarily exerts a frictional force between the thruster pig and the surface of the pipe. For a given pipe and sealing means, the tighter the seal, the greater the friction. When fluid is pumped into the annulus near the entrance of the tubing, the thruster pig and the attached tubing will be urged into the pipe up to a force determined by the annular area and the differential pressure across the thruster pig. The pressure is usually supplied by a pump, and the thruster pig will remain operable so long as the restriction to flow is sufficient to allow the pump to increase the pressure in the annulus to the desired level.

The seals can be any type of seal, including extrusions, cups, chevrons, disks, or a combination thereof. The seal or seals are preferably cups as are used in the art for pipeline pigs. The material of the seals is advantageously elastic so that it can move past obstructions in the pipeline while maintaining some sealing capability, and then reforming an essentially fluid-tight seal after passing the obstruction.

Aperture 56 allows fluids pumped down the interior of the injected tubing to pass through the device into the interior of the pipe ahead of the device 50. Aperture 56 may contain the injected tube, or it may be a continuation of that flow path. When the thruster pig is moving forward, fluid may also be withdrawn from the volume ahead of the pig 50 through aperture 56.

Beneficially, the injected fluid passes through a nozzle 52 that directs the injected fluid and adds velocity to the injected fluid. Depending on the application, many different tools other than the nozzle may also be attached to the thruster apparatus that utilize aperture 56. The tools are generally attached to the front of the thruster pig. High pressure nozzles, wash or jet tools, drills, hammers, and other oil field tools may be attached to the end of the coiled tubing extended reach system to help remove paraffin, scale, hydrates, sand, or other debris as may be encountered. For instance, if cleaning the pipe is necessary, a jet washer tool that sprays water or other chemicals at the walls of the pipe may be attached. A brush-type tool may also be attached to the pig. Likewise, if the pipe is blocked by, for example, solid or waxy deposits, then a tool that is capable of removing the blockage, for example a high pressure nozzle, may be employed. Fluids then can be pumped down the injection tube and out, at high velocity, through the high pressure nozzle or apparatus. Another embodiment is a jet nozzle that does not sweep the bore ahead of the end of the coiled tubing string, but focuses a nozzle on the center of the bore ahead to melt deposits with a minor amount of flow, and the majority of the flow is in the reverse direction to push minor amount of trash backwards in a diluted form. The pumped fluids can be of any conventional type, such as acids, chemicals, lubricating fluids, solvents, surfactants, water, alcohol, and the like. Beneficially, the sealing means should be compatible with the injected fluid.

There is at least one opening 66 through the body, normally sealed by a check valve 60, that provides a path for fluids to flow back through the device and up the annulus. In one embodiment, the body encloses the check valves, and there is a greater number of sealing cups that extend the length of the body. The check valves 60 are positioned to allow flow in a first direction against a soft spring, for example one openable with only 0.01 psi to 100 psi. These valves allow fluid to flow from the front of the pig to the annulus behind the pig. These valves are only activated, however, when pressure ahead of the thruster pig exceeds the pressure behind the thruster pig.

When fluid is pumped into the bore of the tubing, the fluid flows out the distal end of the pig, through the relief valve, into the annulus and back to the entrance end. This way, the thruster pig and tubing can be urged out of the pipe up to a maximum force determined by the annular area and the differential pressure across the thruster pig, wherein the maximum differential pressure is the operating differential of the check valve.

Figure 2:
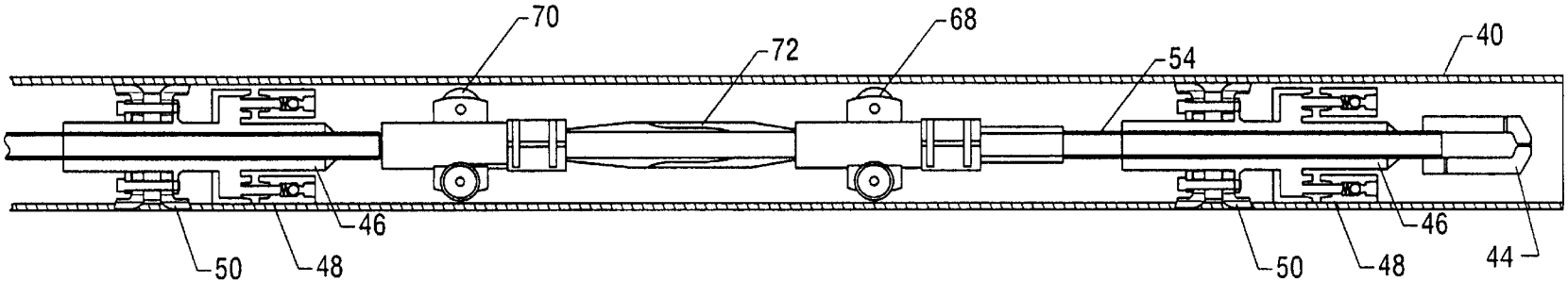
FIG. 2 is an embodiment of the thruster pig and a related skate apparatus in use at the same time.

As shown in FIG. 2, the thruster pig 46 comprises chevrons or cups 50 that seal against the pipe 40. This effectively creates an annulus between the injected tubing 52 and the pipe 40 so that pressure can be applied to the rear of the thruster pig 46. The thruster pig is able to move relative to the internal surface of the pipeline. The seals prevent substantial quantities of fluids from flowing between either the tubing 54 and the thruster pig and between the thruster pig and the interior surface of the pipeline.

The thruster pig contains a plurality, preferably four, check valves 48. The check valves 48 equalize the hydrostatic force on the thruster pig as it is pulled back out of the well or pipe line. The check valves 48 also allow fluid that may be pumped down the injected tubing 54 and through the nozzle head 44 to flow back up the annulus. The check valves are actuated by pressure ahead of the thruster pig being higher than pressure behind the thruster pig.

Two skate apparatuses 68 and 70 are positioned on either side of a standard coupling/fishing neck 72. Other skate apparatuses are beneficially in place at predetermined intervals on the injected pipe.

In the event the thruster pig 46 becomes stuck, a ball injected down the injected tubing can release the fishing neck 72, which can be male or female, and the thin walled injected tubing and skate 70 can be withdrawn. Then, larger or more strong tubing or a fishing hook can be injected into the pipe, can mate and attach to the fishing neck 72, and can exert a greater pulling force than could be generated with typical injected tubing.

It is advantageous that the releasing sub or other connecting means have a stabilizer, also called a centralizer, so that if the thruster pig is left in the pipe after withdrawing the injected tube, then going to retrieve the thruster pig with a fishing operation will be facilitated. The centralizer can be a skate apparatus, and can be either integral with or attached to the thruster pig.

It may sometimes be desirable to include a coupling tool or a pipe connector for attaching check valves, thruster pigs, multiple thruster pigs, release subs, and connecting one or more reels of coiled tubing together. The combination of tools and the spacing will be obvious to one skilled in the art given the disclosure herein.

It may also be beneficial to pump off the thruster pig that is connected to the injected tubing by releasing subs. The releasing sub may trap the ball, thereby closing off the bore in the thruster pig. The thruster pig can then be forced ahead through the pipe until a location is reached where the pig can be removed. This will sweep debris ahead of the pig, cleaning the pipe. The injected tubing is withdrawn without the thruster pig.

The tubing, with the skates either integral with or attached to it, may be inserted into and withdrawn from a pipe by any means. Generally, the means employed is dependent upon the length of tubing to be inserted, as well as, the design of the pipe, i.e., straight, curved, right angle bends, etc. In most instances, the longer the tubing and the more the pipe is curved or bent, the more force that may be required to insert the tubing in the pipe.

In a second embodiment of the invention, a plurality of check valves or other valves are present that allow flow in each direction. The check valves are actuated by pressure differential across the thruster pig. The second set of valves or check valves allows fluids under some conditions to flow from the annulus between the tubing and the interior surface of the pipe to the front of the pig. These check valves may be actuated by higher pressure differentials, for example by 50 to about 1000 psi, across the thruster pig. These check valves are limits on the pressure that can be exerted against the back of the thruster pig during injection, as they will open and allow fluid to pass. These valves may be activated by any other mechanism known to the art, including electric switches, a second injected control tubing, or an injected ball, or the like. These valves are advantageously open when the thruster pig is being withdrawn, so that any fluids that are behind the thruster pig can move to the front of the thruster pig, and therefore need not be swabbed from the well.

When fluid is pumped into the annulus near the entrance of the tubing, the thruster pig and the attached tubing will be urged into the pipe up to a first maximum force determined by the annular area and the differential pressure across the thruster pig, wherein the maximum differential pressure is the operating differential of the first relief valve. Similarly, when fluid is pumped into the bore of the tubing, the fluid flows out the distal end, through the second relief valve, into the annulus and back to the entrance end. The thruster pig and tubing will be urged out of the pipe up to a second maximum force determined by the annular area and the differential pressure across the thruster pig, wherein the maximum differential pressure is the operating differential of the second relief valve. Pressure is usually supplied by a pump, and the thruster pig will remain operable so long as the restriction to flow is sufficient to allow the pump to increase the pressure in the annulus to the desired level.

In a third embodiment of the invention, a plurality of thruster pigs are attached on the injected tubing, either closely spaced or not closely spaced. Check valves that allow fluid to flow from behind the thruster pigs to the front of the thruster pigs are pressure activated, and therefore limit the pressure differential, and the thrust developed by each pig. If two or more thruster pigs are placed in a string and flow is pumped down the annulus, they each can provide a force of 100 psi differential times the annular piston area of the thruster pig. This force would be input into the coiled tubing at the location of the differential pigs instead of just at the ends.

In a fourth embodiment of the invention the thruster pig has a means to attach the body to the tubing having a first position to allow the tubing string to be run through the thruster pig while the pig is held in a stationary position. The thruster pig can then travel to a second predetermined location wherein the thruster will engage the tubing and lock the thruster pig to the tubing. Once engaged, the thruster pig and the tubing will move together.

What is claimed is:

1. A thruster pig for injecting tubing into a pipe, comprising (a) a body having an inner diameter greater than the outer diameter of the injected tubing and having an outer diameter equal to or smaller than an inner diameter of the pipe, (b) an attaching apparatus coupling the body to the end of the outer diameter of the tubing or to the exterior of the small diameter of the tubing, (c) a sealing apparatus to impede fluid migration between the body and the inner surface of the pipe thereby forming an annulus between said tubing and said pipe, (d) an aperture allowing fluids pumped down the interior of the tubing to pass through the body into the interior of the pipe ahead of the body, and (e) means for allowing fluids to flow back through the body and up through the annulus.

2. The thruster pig of claim 1 wherein the attaching apparatus is selected from the group consisting of: releasing subs, hinges, ball joints, swivel joints, or any combinations thereof.

3. The thruster pig of claim 1 wherein the attaching apparatus comprises a flange face that is connected to or integral with the body, said flange face mating to another flange face which is connected to the tubing.

4. The thruster pig of claim 1 wherein the sealing apparatus is selected from the group consisting of: extrusions, cups, chevrons, disks, o-rings, or any combinations thereof.

5. The thruster pig of claim 1 further comprising a tool attached ahead of the thruster pig.

6. The thruster pig of claim 5 wherein the tool attached ahead of the thruster pig is selected from the group consisting of: a high pressure nozzle, a jet washer tool, a drill, a hammer, a skate apparatus, either a male or female fish neck, or any combination thereof.

7. The thruster pig of claim 6 wherein a jet nozzle attached ahead of the thruster pig, which does not sweep the bore ahead of the end of the injected tubing, but instead focuses on the center of the bore ahead to melt deposits with a minor amount of flow, and the majority of the flow is in the reverse direction to push minor amount of trash backwards in a diluted form.

8. The thruster pig of claim 1 wherein the means for allowing fluids to flow back through the body and up through the annulus comprise one or more check valves.

9. The thruster pig of claim 1 wherein the means for allowing fluids to flow back through the body and up through the annulus comprises one or more valves activated open when the thruster pig is being withdrawn from the pipe, thereby allowing fluid behind the thruster pig to pass through the valve or valves to the front of the thruster pig.

10. The thruster pig of claim 1 wherein the means for allowing fluids to flow back through the body and up through the annulus comprises one or more pressure actuated check valves that actuate at between about 0.01 psi and about 10 psi, and further comprises pressure actuated check valves for allowing fluids to flow from the annulus to the front of the device that actuate at between about 50 psi and about 1000 psi.

11. The thruster pig of claim 1 further comprising a centralizer integral with or connected to said thruster pig for maintaining the thruster pig substantially centralized within the pipe.

12. A thruster pig for injecting injected tubing into a pipe, comprising:

(a) a body having an entrance end and a distal end, the body also having an inner diameter greater than an outer diameter of the tubing and having an outer diameter equal to or smaller than an inner diameter of the pipe, (b) a means to attach said body to said tubing (c) a means attached to said body to sealingly engage the inner surface of said pipe, thereby forming an annulus between said tubing and said pipe, (d) a means for sealing said body to said tubing, (e) an aperture allowing fluids pumped down the interior of the tubing to pass through the body into the interior of the pipe ahead of the body, (f) a relief valve presettable to limit a first pressure differential from said entrance end of the body to said distal end of the body to a determined maximum, and (g) a second relief valve presettable to limit a second pressure differential from said distal end of the body to said entrance end of the body determined to a maximum, such that when fluid is pumped in to the annulus near the entrance end of said injected tubing is urged into said pipe up to a first determined maximum force determined by the annular area and said first pressure differential, and such that when fluid is pumped into the interior of said tubing, the fluid flows out the distal end, through the second relief valve, into the annulus and back to the entrance end, and wherein said thruster pig and said tubing are urged out of said pipe up to a second determined maximum force determined by said annular area and said second pressure differential.

13. The thruster pig of claim 12 wherein said means attached to said body to sealingly engage the inner surface of said pipe exerts a frictional force against said inner surface of said pipe.

14. The thruster pig of claim 13 wherein said second maximum force determined by said annular area and said second pressure differential is less than said frictional force such that said thruster pig does not move out of said pipe when fluid flows out the distal end, through the second relief valve, into the annulus, and back to the entrance end.

15. The thruster pig of claim 12 wherein two or more thruster pigs are attached to said tubing at different locations to apply said first maximum force onto said tubing at said different locations.

16. The thruster pig of claim 15 wherein said first maximum force is different for one thruster pig than for another thruster pig.

17. The thruster pig of claim 12 wherein said means to attach said body to said tubing has a first position to allow said tubing to be run through one or more of said thruster pigs held in a stationary position and wherein each of said means to attach said body are individually moveable to a second position to lock said thruster pig to said tubing for movement of said thruster pig with said tubing.

* * * * *